US008118511B1

(12) United States Patent
Stadnyk

(10) Patent No.: US 8,118,511 B1
(45) Date of Patent: Feb. 21, 2012

(54) PORTABLE LIQUID POD SYSTEM

(76) Inventor: Mark A. Stadnyk, Ridge Manor, FL (US)

( * ) Notice: Subject to any disclaimer, the term of this patent is extended or adjusted under 35 U.S.C. 154(b) by 1195 days.

(21) Appl. No.: 11/900,879

(22) Filed: Sep. 13, 2007

(51) Int. Cl.
*B43K 23/12* (2006.01)
*B43M 11/06* (2006.01)

(52) U.S. Cl. ..... 401/262; 401/198; 15/244.1; 15/104.93

(58) Field of Classification Search ..... 401/9, 10, 401/12, 196, 198, 202, 207, 262, 183; 15/244.1, 15/244.4, 104.93, 104.94
See application file for complete search history.

(56) References Cited

U.S. PATENT DOCUMENTS 3,756,732 A * 9/1973 Stoffler ..... 401/202
4,023,712 A 5/1977 Babiak et al.
4,237,641 A * 12/1980 Gupton ..... 43/25
5,230,579 A * 7/1993 Klawson et al. ..... 401/205
5,906,298 A 5/1999 Ward
6,464,110 B1 10/2002 Yamada
6,626,599 B2 * 9/2003 De Laforcade ..... 401/10

* cited by examiner

*Primary Examiner* — David Walczak

(57) ABSTRACT

A body has a closed bottom and an open top. The body has a periphery. The body has a side wall. The body is fabricated of a semi-soft squeezable plastic material. A stem is in a cylindrical configuration. The stem is supported within the body. The stem is fabricated of a hard plastic material. A sponge has a bottom. The bottom of the sponge is positioned on the bottom of the body. The sponge has a top. The top of the sponge extends above the body. The sponge is fabricated of an absorbent foam material. A protective cap is provided. The cap has a closed top and an open bottom. The cap has a periphery. The cap has a side wall. The peripheries are adapted to releasably couple the cap with respect to the body.

1 Claim, 4 Drawing Sheets

FIG. 1
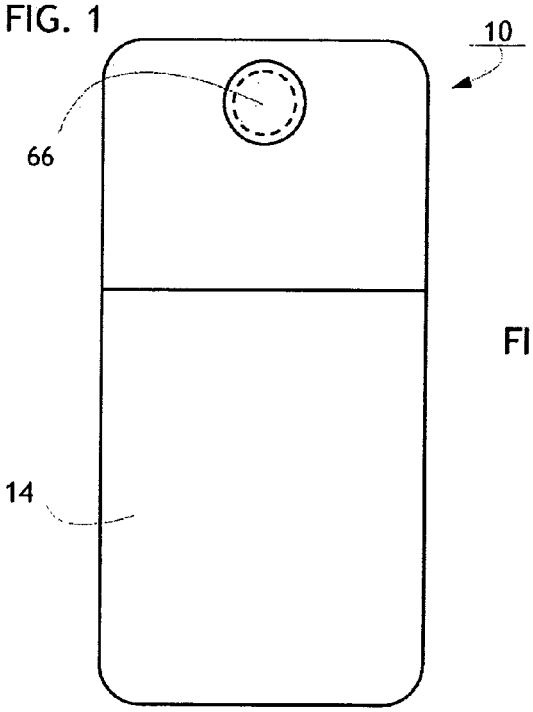
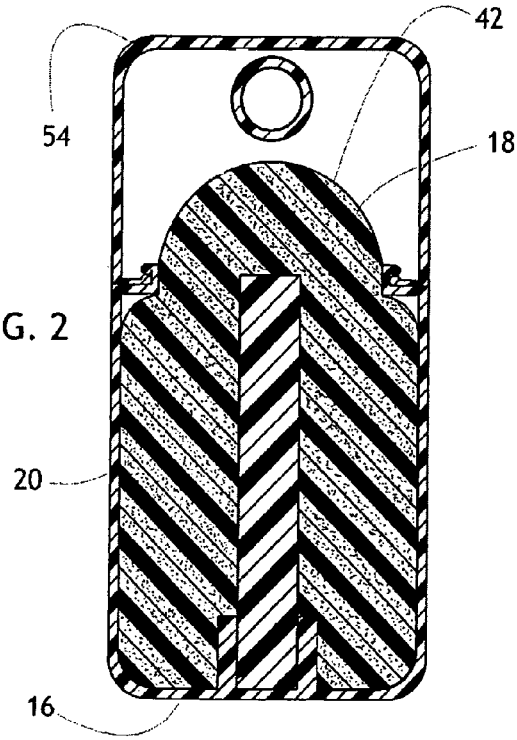
FIG. 2
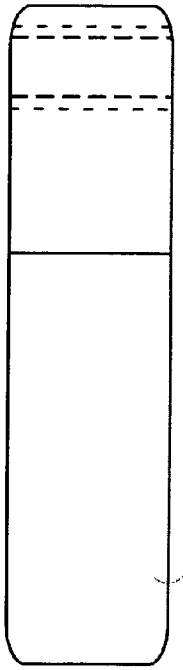
FIG. 3
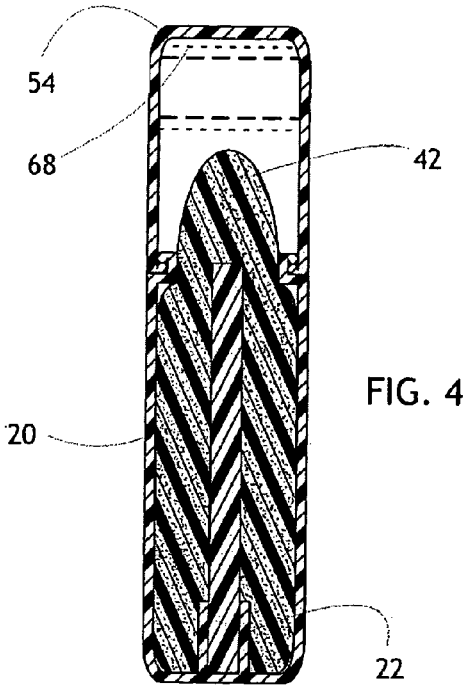
FIG. 4

FIG. 9
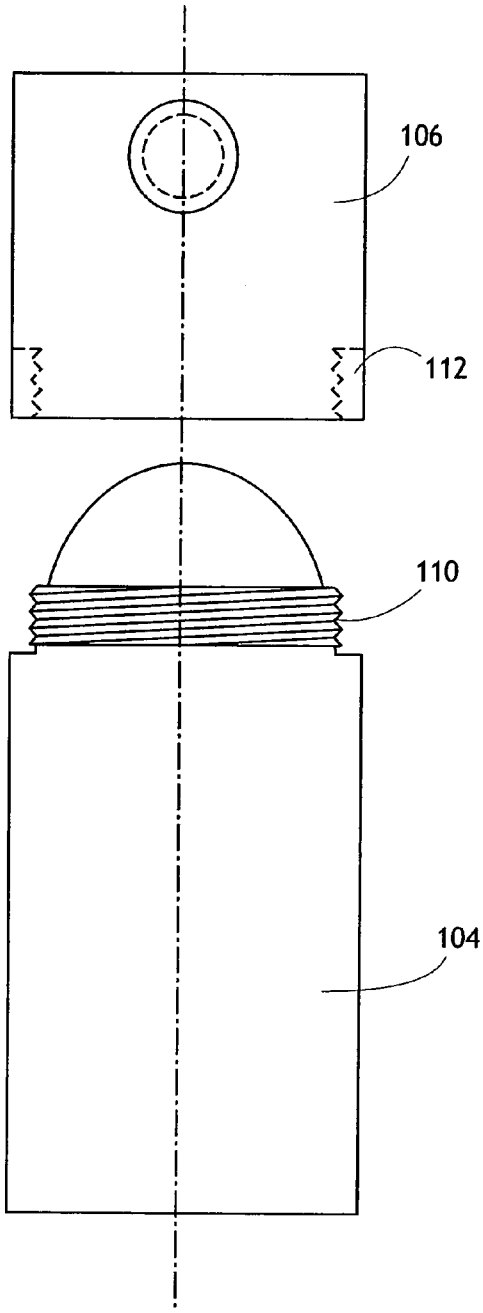
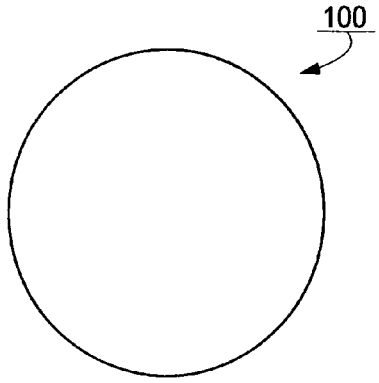
FIG. 10
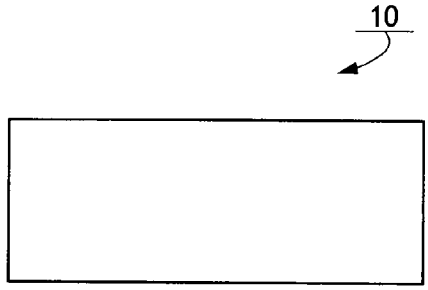
FIG. 11
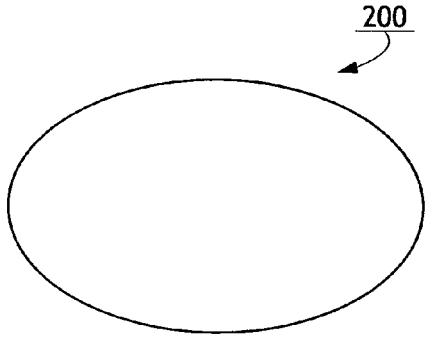
FIG. 12

PORTABLE LIQUID POD SYSTEM

BACKGROUND OF THE INVENTION

1. Field of the Invention

The present invention relates to a portable liquid pod system and more particularly pertains to storing and dispensing a liquid in a safe, convenient and economical manner.

2. Description of the Prior Art

The use of liquid dispensing systems of known designs and configurations is known in the prior art. More specifically, liquid dispensing systems of known designs and configurations previously devised and utilized for the purpose of dispensing liquid through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,906,298 issued May 25, 1999 to Ward relates to a Scent Dispersal System. U.S. Pat. No. 4,023,712 to Babiak relates to a Portable Spray Container System. Lastly, U.S. Pat. No. 6,464,110 to Yamada relates to a Perfume Dispensing Implement.

While these devices fulfill their respective, particular objectives and requirements, the aforementioned patents do not describe a portable liquid pod system that allows for storing and dispensing a liquid in a safe, convenient and economical manner.

In this respect, the portable liquid pod system according to the present invention substantially departs from the conventional concepts and designs of the prior art, and in doing so provides an apparatus primarily developed for the purpose of storing and dispensing a liquid in a safe, convenient and economical manner.

Therefore, it can be appreciated that there exists a continuing need for a new and improved portable liquid pod system which can be used for storing and dispensing a liquid in a safe, convenient and economical manner. In this regard, the present invention substantially fulfills this need.

SUMMARY OF THE INVENTION

In view of the foregoing disadvantages inherent in the known types of liquid dispersement systems of known designs and configurations now present in the prior art, the present invention provides an improved portable liquid pod system. As such, the general purpose of the present invention, which will be described subsequently in greater detail, is to provide a new and improved portable liquid pod system and method which has all the advantages of the prior art and none of the disadvantages.

To attain this, the present invention essentially comprises a portable liquid pod system. First provided is a main body. The main body has a closed bottom. The main body has an open top. The main body has a cylindrical side wall. A height is provided between the top and the bottom. The bottom has a centrally located upwardly extending cylindrical support. The support has a height of about 20 percent of the height of the side wall. The open top has a periphery. The periphery has an inwardly extending primary ledge. The primary ledge has a length of about 10 percent of the length of the support. The periphery has an upwardly extending secondary ledge. The secondary ledge has a length less than the length of the primary ledge. The periphery has an outwardly extending tertiary ledge. The tertiary ledge is in a semi-cylindrical configuration. The tertiary ledge has a length less than the length of the secondary support ledge. The main body has a chamber. The chamber is provided between the top and the bottom and within the side wall. The main body, its support and ledges are fabricated of a semi-soft squeezable plastic casing.

A long stem is provided. The stem is in a cylindrical configuration. The stem is further in a cross sectional configuration. In this manner the stem may be removably received within the support. The stem has a lower end. The lower end of the stem is located within the support. The stem has an upper end. The upper end of the stem is centrally located between the secondary ledge. The stem has a volume of about 15 percent of the volume of the chamber. The stem is fabricated of a hard plastic material.

Provided next is a sponge. The sponge has a flat bottom. The bottom of the sponge is positioned on the bottom of the main body. The sponge has a curved top. The top extends above the main body. In this manner a height is defined. The sponge has a side wall. The side wall of the sponge is in contact with the side wall of the main body. The height of the sponge is about 20 percent higher than the height of the main body. The sponge has a recess. The recess extends upwardly from its bottom. In this manner the recess may slidably receive the support and the stem. The sponge is glued to the body. The sponge is fabricated of an absorbent foam material. The absorbent foam material is selected from the class of absorbent foam materials. The class of absorbent foam materials includes sponge, natural and synthetic and blends thereof.

Further provided is a protective cap. The cap has a closed top. The cap has an open bottom. The cap has a cylindrical side wall. A height is provided between the top and the bottom. The height of the cap is about 25 percent of the height of the body. The open bottom has a periphery. The periphery has an inwardly extending primary ledge. The length of the primary ledge is essentially equal to the length of the primary ledge of the body. The periphery has an upwardly extending secondary ledge. The secondary ledge is in a semi-cylindrical configuration. The length of the secondary ledge is essentially equal to the length of the tertiary ledge of the body. The ledges are adapted to releasably couple the cap with respect to the body. The cap has an opening. The opening extends through the side wall of the cap. The cap has a cylindrical tube. In this manner the sponge is sealed from the atmosphere when the cap is on the body. The cap has a supporting member. The opening and the tube are adapted to receive the supporting member. The supporting member is selected from the class of supporting members. The class of supporting members includes a ring, chain, strap and lanyard. The main body, its support and ledges and tube are fabricated of a plastic material.

Provided last is a liquid. The liquid is supported within the sponge. The liquid is adapted to be dispensed when the cap is removed and the side walls of the body are squeezed with the top of the sponge in contact with a user. The liquid is selected from the class of liquids. The class of liquids includes cologne, mosquito repellant and antiseptic.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable liquid pod system which has all of the advantages of the prior art liquid dispensing systems of known designs and configurations and none of the disadvantages.

It is another object of the present invention to provide a new and improved portable liquid pod system which may be easily and efficiently manufactured and marketed.

It is further object of the present invention to provide a new and improved portable liquid pod system which is of durable and reliable constructions.

An even further object of the present invention is to provide a new and improved portable liquid pod system which is susceptible of a low cost of manufacture with regard to both materials and labor, and which accordingly is then susceptible of low prices of sale to the consuming public, thereby making such portable liquid pod system economically available to the buying public.

Even still another object of the present invention is to provide a portable liquid pod system for storing and dispensing a liquid in a safe, convenient and economical manner.

Lastly, it is an object of the present invention to provide a new and improved portable liquid pod system. A body has a closed bottom and an open top. The body has a periphery. The body has a side wall. The body is fabricated of a semi-soft squeezable plastic material. A stem is in a cylindrical configuration. The stem is supported within the body. The stem is fabricated of a hard plastic material. A sponge has a bottom. The bottom of the sponge is positioned on the bottom of the body. The sponge has a top. The top of the sponge extends above the body. The sponge is fabricated of an absorbent foam material. A protective cap is provided. The cap has a closed top and an open bottom. The cap has a periphery. The cap has a side wall. The peripheries are adapted to releasably couple the cap with respect to the body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a portable fragrance system constructed in accordance with the principles of the present invention.

FIG. 2 is a cross sectional view taken vertically through the system of FIG. 1.

FIG. 3 is a side elevational view of the portable fragrance system shown in FIG. 1.

FIG. 4 is a cross sectional view taken vertically through the system of FIG. 3.

FIG. 9 is an exploded view of a system constructed in accordance with another alternate embodiment of the invention.

FIGS. 10, 11 and 12 are plan views of three embodiments of the invention.

The same reference numerals refer to the same parts throughout the various Figures.

DESCRIPTION OF THE PREFERRED EMBODIMENT

Figure 5:
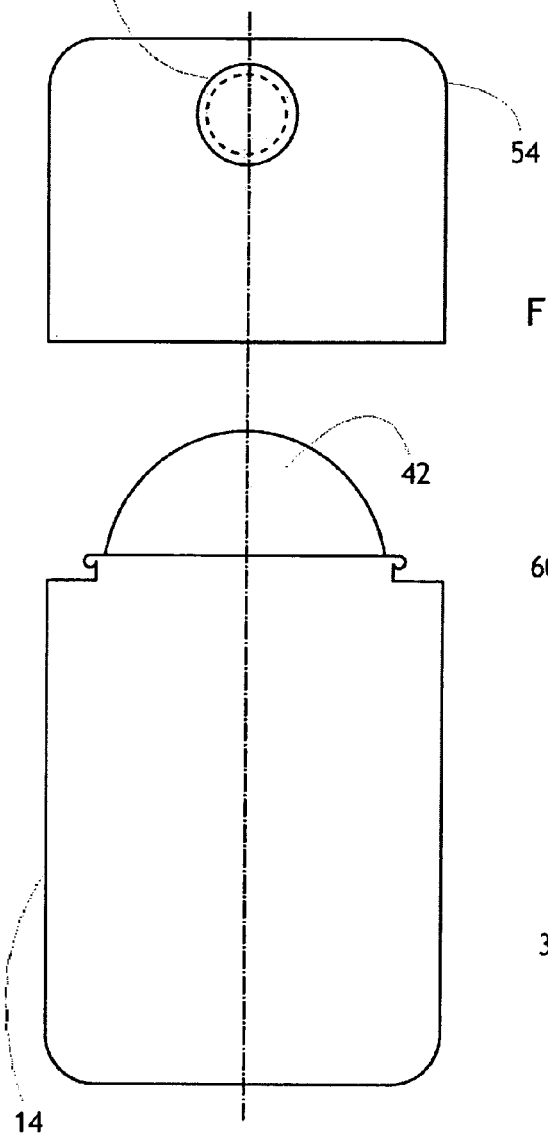
FIG. 5 is an exploded view of the system illustrated in FIG. 1.
Figure 6:
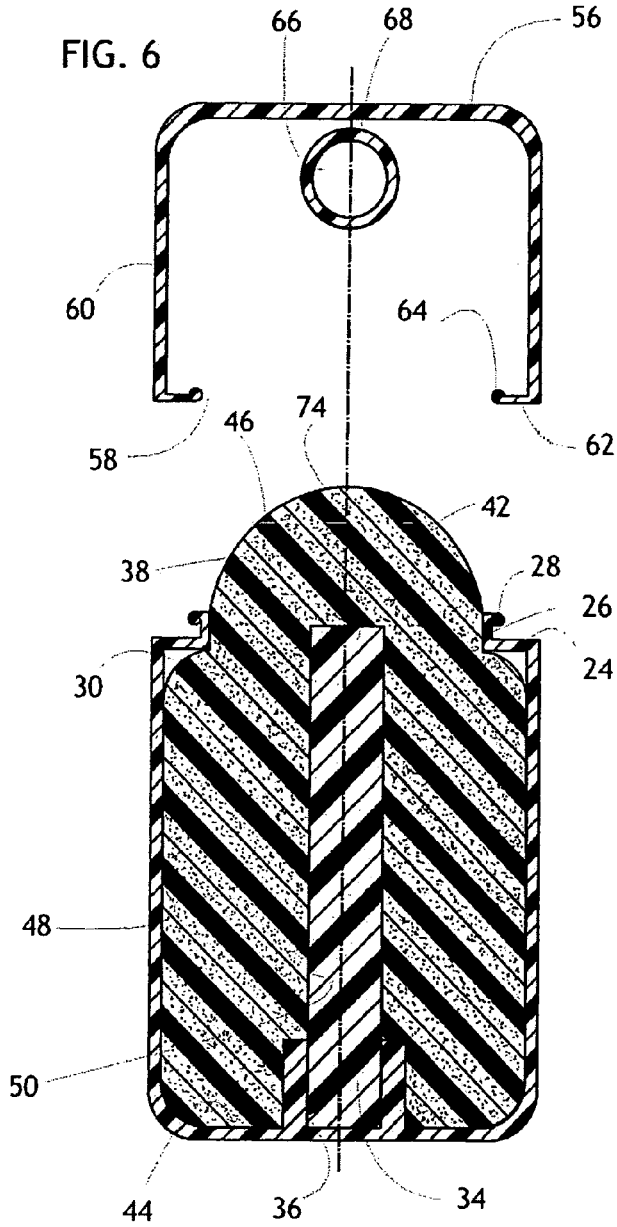
FIG. 6 is an exploded cross sectional view of the system illustrated in FIG. 2.
Figure 7:
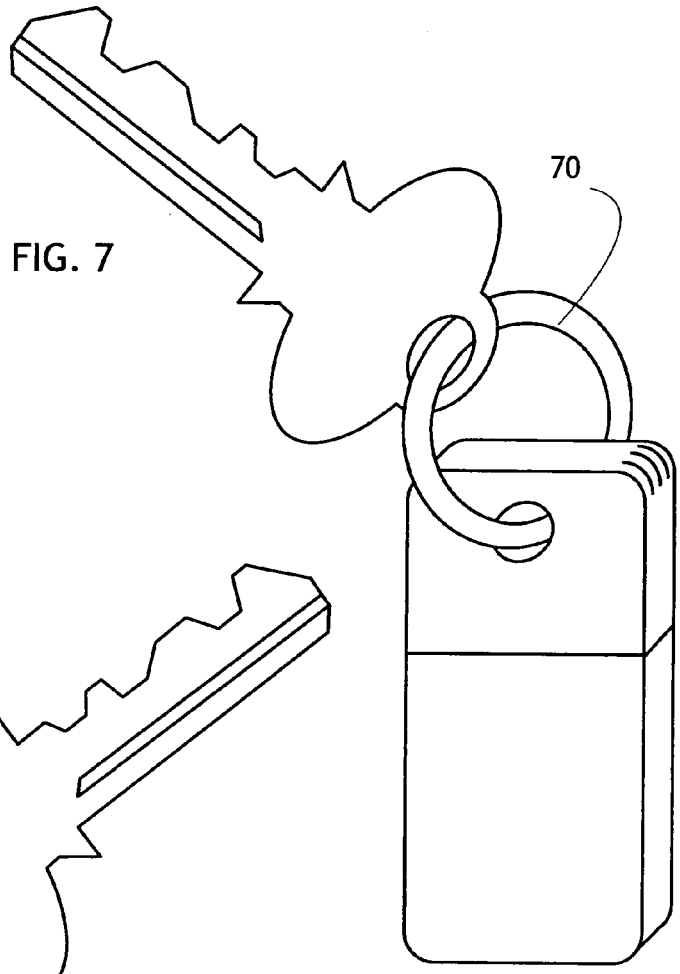
FIG. 7 is a perspective illustration of the system illustrated in the prior Figures with the system supported on a key ring.

With reference now to the drawings, and in particular to FIG. 1 thereof, the preferred embodiment of the new and improved portable liquid pod system embodying the principles and concepts of the present invention and generally designated by the reference numeral 10 will be described.

The present invention, the portable liquid pod system 10 is comprised of a plurality of components. Such components in their broadest context include a body, a stem, a sponge and a protective cap. Such components are individually configured and correlated with respect to each other so as to attain the desired objective.

First provided is a main body 14. The main body has a closed bottom 16. The main body has an open top 18. The main body has a cylindrical side wall 20. A height is provided between the to and the bottom. The bottom has a centrally located upwardly extending cylindrical support 22. The support has a height of about 20 percent of the height of the side wall. The open top has a periphery. The periphery has an inwardly extending primary ledge 24. The primary ledge has a length of about 10 percent of the length of the support. The periphery has an upwardly extending secondary ledge 26. The secondary ledge has a length less than the length of the primary ledge. The periphery has an outwardly extending tertiary ledge 28. The tertiary ledge is in a semi-cylindrical configuration. The tertiary ledge has a length less than the length of the secondary ledge. The main body has a chamber 30. The chamber is provided between the top and the bottom and within the side wall. The main body, its support and ledges are fabricated of a semi-soft squeezable plastic casing.

A long stem 34 is provided. The stem is in a cylindrical configuration. The stem is further in a cross sectional configuration. In this manner the stem may be removably received within the support. The stem has a lower end 36. The lower end of the stem is located within the support. The stem has an upper end 38. The upper end of the stem is centrally located between the secondary ledge. The stem has a volume of about 15 percent of the volume of the chamber. The stem is fabricated of a hard plastic material.

Provided next is a sponge 42. The sponge has a flat bottom 44. The bottom of the sponge is positioned on the bottom of the main body. The sponge has a curved top 46. The top extends above the main body. In this manner a height is defined. The sponge has a side wall 48. The side wall of the sponge is in contact with the side wall of the main body. The height of the sponge is about 20 percent higher than the height of the main body. The sponge has a recess 50. The recess extends upwardly from its bottom. In this manner the recess may slidably receive the support and the stem. The sponge is glued to the body. The sponge is fabricated of an absorbent foam material. The absorbent foam material is selected form the class of absorbent foam materials. The class of absorbent foam materials includes sponge, natural and synthetic and blends thereof.

Further provided is a protective cap 54. The cap has a closed top 56. The cap has an open bottom 58. The cap has a cylindrical side wall 60. A height is provided between the top and the bottom. The height of the cap is about 25 percent of the height of the body. The open bottom has a periphery. The periphery has an inwardly extending primary ledge 62. The length of the primary ledge is essentially equal to the length of the primary ledge of the body. The periphery has an upwardly extending secondary ledge 64. The secondary ledge is in a semi-cylindrical configuration. The length of the secondary ledge is essentially equal to the length of the tertiary ledge of the body. The ledges are adapted to releasably couple the cap with respect to the body. The cap has an opening 66. The opening extends through the side wall of the cap. The cap has a cylindrical tube 68. In this manner the sponge is sealed from the atmosphere when the cap is on the body. The cap has a supporting member 70. The opening and the tube are adapted to receive the supporting member. The supporting member is selected from the class of supporting members. The class of supporting members includes a ring, chain, strap and lanyard. The main body, its support and ledges and tube are fabricated of a plastic material.

Provided last is a liquid 74. The liquid is supported within the sponge. The liquid is adapted to be dispensed when the cap is removed and the side walls of the body are squeezed with the top of the sponge in contact with a user. The liquid is selected from the class of liquids. The class of liquids includes cologne, mosquito repellant and antiseptic.

Figure 8:
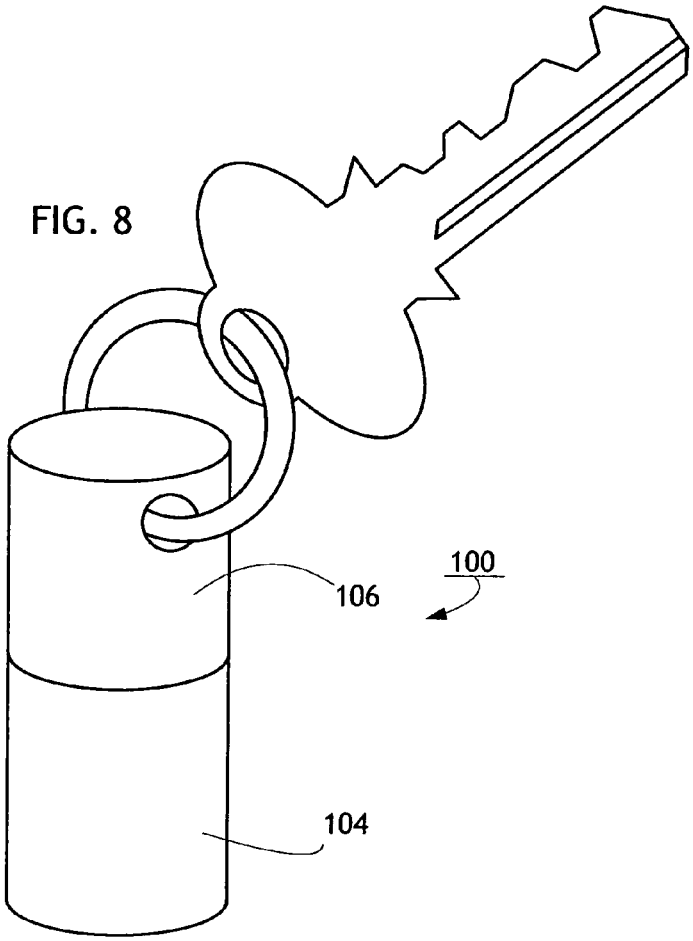
FIG. 8 is a perspective illustration similar to FIG. 7 but illustrating a system constructed in accordance with an alternate embodiment of the invention.

Note now the embodiment 100 of FIGS. 8, 9 and 10. A body 104 is provided. A cap 106 is also provided. The body and cap are cylindrical. The body and cap are in a circular configuration. The peripheries include male threads 110. The male threads are provided on the body. The peripheries further include female threads 112. The female threads are provided on the cap.

The purpose of this system is to store a small amount of liquid cologne or perfume so that it can be carried in pocket or purse and easily dispensed when needed. The device is portable, refillable and disposable. It is designed to be filled and refilled by the user from their existing bottles of cologne so they can make their favorite fragrances portable without needing to carry around the original bottle. This is especially beneficial when traveling by air where security regulations restrict the amount of liquids that can be carried onto an airplane.

Other uses of the system could be to hold and dispense liquid mosquito repellant, antiseptic, astringent or any other liquid that may be swabbed or applied to the skin.

The system is typically a thumb-sized pill-shaped hollow container made of soft, squeezable plastic. The main body constitutes about 75 percent of the total size and contains all the internal parts in a cavity designed to store liquid. A hollow protective plastic cap about 25 percent of the total size of the device snaps or screws onto the top of the main body to seal it closed. The cap has a hole or hoop at the top for attachment to a key chain, neck chain or lanyard.

The overall profile of the system can be oval or rectangular or circular in shape. It could be more flat and oval at the bottom curving upward to be round at the top. The embodiment could include any number of shapes, so long as the device is small enough to be carried in a pocket, purse or hung on a key chain or lanyard.

The system has four components. The first component is a main body which is a semi-soft, squeezable plastic casing, approximately 1.25 inches in height. 0.75 inches wide and 0.375 inches thick. This casing has an opening at the top with an indented rim designed to receive a plastic snap-on cap, or a screw-on cap if round. For snap-on caps the rim will have a curved lip designed to receive the cap and seal the opening, preventing liquid or air from escaping from the casing when attached.

The plastic casing is designed for repeated use such that when squeezing pressure is released, the casing returns to its previous shape and can be squeezed over and over again as needed. Although the casing is reusable and refillable, it is inexpensive enough to also be disposable.

The shape of the casing may be rectangular, oval, round or a combination of these shapes. The casing shall be made in different colors so the user may categorize the contents by color.

The second component is a hard, long, plastic stem that protrudes up through the center of the body, from bottom to top. This stem takes up about 15 percent of the volume of the hollow body or chamber and may be rectangular or cylindrical in shape. Its purpose is to provide a hard solid core upon which one can depress the pump valve of a fragrance spray bottle to release its liquid. The stem is inserted into a protrusion at the bottom of the casing for support, but it may also be supported at the top opening via two or more outwardly protruding spokes. The spokes would secure the top of the stem to the casing opening, keeping it centered within the casing.

The third component of the system is an absorbent foam sponge insert that fills the remaining space of the hollow body, surrounding the central hard plastic stem and protruding up past the top of the body, out through the opening, about 0.25 to 0.375 inches. The foam sponge shall be able to absorb water-based and alcohol-based liquids. It will be glued to the bottom of the casing to prevent it from coming out.

The fourth component of the system is a plastic protective cap approximately 0.5 inch tall that snaps or screws onto the top of the main body, casing, to seal the opening preventing air from getting in, and liquid from getting out. Snap-on caps shall have a curved lip designed to snap onto the casing to seal in liquid and air. The cap also has a key ring hole at the top allowing the attachment of the pod to a ring, chain or lanyard. The key ring hole is sealed off rom the interior of the cap to prevent leakage of air or liquid.

The fluid may be considered as a final component of the system.

In operation, the system is filled and refilled by removing the cap to expose the foam cushion tip. Holding the device vertically with the foam tip pointing upward, a cologne bottle with its spray nozzle removed is then inverted over the top of the device. The spray stem of the bottle, a hard plastic tube which is now protruding downward, is then pressed down onto the internal stem of the device. This action depresses the cologne bottle's tubular stem releasing cologne through the tube, which then trickles down into the absorbent foam-filled casing. When the foam is saturated with liquid and the casing is full, the cologne bottle is removed and the protective cap is snapped or screwed back onto the top of the device to prevent the cologne or liquid from evaporating or dripping out.

For open-top dispensing bottles the device's foam tip can be used to soak up liquid by placing the device atop the dispensing bottle then inverting both, allowing liquid to trickle down into the device. Alternately, the device may be inverted and the open tip placed down into a liquid and filled by squeezing and releasing the casing, thereby drawing the liquid up into the foam and casing.

If a cologne bottle's spray nozzle is not removable, the foam tip can be placed against the spray nozzle opening, and with repeated sprays the cologne can be dispensed into the foam tip and absorbed down into the casing.

To use the cologne stored in the device, the user would remove the cap, then swab the foam tip across their skin to transfer the liquid fragrance. The soft casing of the device may be gently squeezed to help dispense the fragrance through the foam tip.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable liquid pod system for storing and dispensing a liquid in a safe, convenient and economical manner comprising, in combination:

a main body having a closed bottom and an open top with a cylindrical side wall having a height there between, the bottom being formed with a centrally located upwardly extending cylindrical support having a height of about 20 percent of the height of the side wall, the open top having a periphery with an inwardly extending primary ledge of a length of about 10 percent of the length of the support and an upwardly extending secondary ledge of a length less than the length of the primary ledge and an outwardly extending tertiary ledge in a semi-cylindrical configuration of a length less than the length of the secondary ledge, the main body defining a chamber between the top and the bottom and within the side wall, the main body with its support and ledges being fabricated of a semi-soft squeezable plastic casing;

a long stem in a cylindrical configuration with a cross sectional configuration for being removably received within the support, the stem having a lower end located within the support an upper end centrally located between the secondary ledge, the stem having a volume of about 15 percent of the volume of the chamber, the stem being fabricated of a hard plastic material;

a sponge having a flat bottom positioned on the bottom of the main body and a curved top extending above the main body defining a height and with a side wall in contact with the side wall of the main body, the height of the sponge being about 20 percent higher than the height of the main body, the sponge having a recess extending upwardly from its bottom to slidably receive the support and the stem, the sponge being glued to the body and fabricated of an absorbent foam material selected form the class of absorbent foam materials including sponge, natural and synthetic and blends thereof;

a protective cap having a closed top and an open bottom with a cylindrical side wall having a height there between, the height of the cap being about 25 percent of the height of the body, the open bottom having a periphery with an inwardly extending primary ledge of a length essentially equal to the length of the primary ledge of the body and an upwardly extending secondary ledge in a semi-cylindrical configuration of a length essentially equal to the length of the tertiary ledge of the body, the ledges adapted to releasably couple the cap with respect to the body, an opening extending through the side-Wall of the cap with a cylindrical tube for sealing the sponge from the atmosphere when the cap is on the body, the opening and the tube adapted to receive a supporting member selected from the class of supporting members including a ring, chain, strap and lanyard, the main body with its support and ledges and tuba being fabricated of a plastic material; and a liquid supported within the sponge and adapted to be dispensed when the cap is removed and the side walls of the body are squeezed with the top of the sponge in contact with a user, the liquid being selected from the class of liquids including cologne, mosquito repellant and antiseptic.

* * * * *